US009195217B2

(12) United States Patent
Beugin et al.

(10) Patent No.: US 9,195,217 B2
(45) Date of Patent: Nov. 24, 2015

(54) WATCH CANNON-PINION

(71) Applicant: Montres Breguet S.A., L'Abbaye (CH)

(72) Inventors: Stephane Beugin, Les Rousses (FR); Gaetan Villard, L'abbaye (CH); Lucien Germond, Grandson (CH); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/553,186

(22) Filed: Nov. 25, 2014

(65) Prior Publication Data

US 2015/0160615 A1 Jun. 11, 2015

(30) Foreign Application Priority Data

Dec. 9, 2013 (EP) ..... 13196153

(51) Int. Cl.
*G04B 13/02* (2006.01)

(52) U.S. Cl.
CPC ..... *G04B 13/02* (2013.01); *G04B 13/026* (2013.01)

(58) Field of Classification Search
CPC ..... G04B 13/02; G04B 13/026
USPC ..... 368/322, 323
See application file for complete search history.

(56) References Cited

U.S. PATENT DOCUMENTS

| | | | | |
|---|---|---|---|---|
| 520,298 | A | 5/1894 | Coats | |
| 2,535,483 | A | 12/1950 | Childs, III | |
| 4,293,942 | A | 10/1981 | Baumgartner | |
| 6,019,860 | A * | 2/2000 | Turler et al. | 148/563 |
| 2008/0101162 | A1 * | 5/2008 | Born | 368/132 |

FOREIGN PATENT DOCUMENTS

| | | |
|---|---|---|
| EP | 1 580 625 A1 | 9/2005 |
| GB | 2 037 029 A | 7/1980 |
| JP | 61-142025 | 6/1986 |
| WO | WO 89/12175 | 12/1989 |

OTHER PUBLICATIONS

European Search Report issued Jul. 16, 2014, in European Application No. 13196153.4 filed Dec. 9, 2013 (with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

Watch cannon-pinion including a first bore for receiving a pivot-shank including, on either side of a recess, a first shoulder and a second shoulder.

This cannon-pinion is made in two parts and includes, on the one hand, a body comprising internally the first bore and externally a support shoulder, and on the other hand, a shape memory alloy ring including a second bore, and, in the free state, the second bore has a larger diameter than that of the support shoulder when the ring is in a martensitic structure, and a smaller diameter than that of the support shoulder when the ring is in an austenitic structure.

16 Claims, 1 Drawing Sheet

WATCH CANNON-PINION

This application claims priority from European Patent Application No. 13196153.4 filed on Sep. 12, 2013, the entire disclosure of which is hereby incorporated herein by reference.

FIELD OF THE INVENTION

The invention concerns a watch cannon-pinion including a first bore for receiving a pivot-shank which includes, on either side of a recess of a given width, a first shoulder of a first length and a second shoulder of a second length.

The invention also concerns a timepiece movement comprising at least one such cannon-pinion.

The invention also concerns a timepiece including at least one such movement and/or at least one such cannon-pinion.

The invention also concerns an indenting method.

The invention concerns the field of timepiece movements, in particular mechanical movements, and more particularly the driving of the display members, such as hands, or discs, or other moving elements.

BACKGROUND OF THE INVENTION

Timepiece movements, particularly mechanical movements, generally include cannon-pinions for driving display hands or discs. A first cannon-pinion is positioned and indented on the pivot-shank of the centre pinion.

The indenting operation consists in squeezing a tube comprised in the cannon-pinion opposite to a shoulder or to a recess of the pivot-shank. This squeezing is a manual operation, and the result thereof depends on the dexterity and sensitivity of the watchmaker, and is consequently random, which is annoying, since the object of indenting is to ensure a certain level of friction between the pivot-shank and the cannon-pinion during normal operation of the watch, while the manual time-setting operations performed by the user apply a higher torque than the friction torque; and therefore said friction torque should not be too high. Further, a friction torque that is too low will tend to cause interference' in the display state when accidental shocks are applied to the product.

Adjusting friction torque correctly is thus a difficult operation. Moreover, indenting frequently causes after-sales problems, since the cannon-pinion is a fragile component, and repeating indenting after disassembly often results in deterioration requiring the cannon-pinion to be replaced.

It is therefore important to control precisely the clamping force, and conventional manual indenting cannot achieve such precision or the required reproducibility.

SUMMARY OF THE INVENTION

The invention proposes to provide an alternative to manual indenting which is too random, and to replace it with a reproducible attachment of the pivot-shank, which is less dependent on the operator performing the assembly.

To this end, the invention concerns a watch cannon-pinion including a first bore for receiving a pivot-shank that includes, on either side of a recess of a given width, a first shoulder of a first length and a second shoulder of a second length, characterized in that said cannon-pinion is made in at least two parts and includes, on the one hand, a body comprising internally said first bore and externally a support shoulder, and on the other hand, at least one ring made of a shape memory alloy including a second bore, and in that said second bore, in the free state, has a larger diameter than that of the support shoulder when said ring is in a martensitic structure, and a smaller diameter than that of the support shoulder when said ring is in an austenitic structure.

The invention also concerns a timepiece movement comprising at least one such cannon-pinion.

The invention also concerns a timepiece including at least one such movement and/or at least one such cannon-pinion.

The invention also concerns an indenting method, which can easily be automated using a manipulator robot comprising means of heating or cooling in a localised and virtually instantaneous manner, via which various successive steps are performed:

- a pivot-shank is inserted into a first bore in a cannon-pinion body, and preferably until a stop position is reached in a particular implementation;
- a shape memory alloy ring is prepared for gripping a support shoulder on a tubular body comprised in said body facing said pivot-shank, said ring including a second bore which, in the free state, has a larger diameter than that of the support shoulder when the ring is in a martensitic structure, and a smaller diameter than that of the support shoulder when the ring is in an austenitic structure;
- a first phase is effected for the initial deformation of the shape memory alloy ring in a first martensitic state and at a lower temperature than a first transformation start temperature, characteristic of the start of transformation of the martensitic structure into an austenitic structure upon heating;
- a second phase is effected to install the ring on the support shoulder of the cannon-pinion, still in the first martensitic state and at a lower temperature than the first transformation temperature;
- a third phase is effected, in which the ring is clamped onto the cannon-pinion by heating to a higher temperature than a second end of transformation temperature.

BRIEF DESCRIPTION OF THE DRAWINGS

Other features and advantages of the invention will appear upon reading the following detailed description, with reference to the annexed drawings, in which:

FIG. 3 shows the ring in the free state;

FIG. 4 shows the expansion of the ring under the effect of a pseudoplastic deformation induced state change, consisting in the permanent but reversible re-orientation of the martensite;

FIG. 5 shows the ring fitted onto the cannon-pinion body provided with the pivot-shank (which is not shown);

FIG. 6 shows the contraction of the ring with clamping force onto the cannon-pinion body;

DETAILED DESCRIPTION OF PREFERRED EMBODIMENTS

Figure 1:
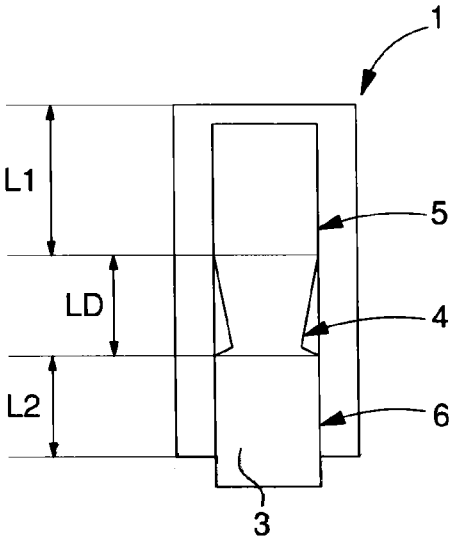
FIG. 1 shows a schematic view, in cross-section along the pivot axis, of a cannon-pinion indented in a conventional manner through the manual deformation of the cannon-pinion tube opposite to a recess in the pivot-shank.

The invention concerns the field of timepiece movements, in particular mechanical movements, and more particularly the driving of the display members, such as hands, or discs, or other moving elements.

The invention proposes to ensure attachment of the pivot-shank in a reproducible manner, less dependent on the operator performing the assembly and preferably achievable with automated production means, such as an assembly robot or similar, for gripping and positioning the components in relation to each other, wherein said robot is capable of selectively applying localised and virtually instantaneous heating or cooling to said components.

The invention therefore concerns a watch cannon-pinion 1 including a first bore 2 for receiving a pivot-shank 3, which includes, on either side of a recess 4 of a given width LD, a first shoulder 5 of a first length L1 and a second shoulder of a second length L2.

According to the invention, this cannon-pinion 1 is made in at least two parts, and includes, on the one hand, a body 10 comprising internally the first bore 2 and externally a support shoulder 7, and on the other hand, at least one ring 8. This at least one ring 8 is made of shape memory alloy, and includes a second bore 9.

The shape memory alloy may be chosen from various families of materials, particularly and in a non-limiting manner, heat-activated shape memory alloys, magnetically-activated shape memory alloys, or shape memory polymers.

A distinction is generally made, for such shape memory alloys, between a martensitic state and an austenitic state, which refer to different crystal structures of the material.

In the free state, the second bore 9 has a larger diameter than that of support shoulder 7 when ring 8 is in a martensitic structure, and a smaller diameter than that of support shoulder 7 when ring 8 is in an austenitic structure.

Specifically and advantageously, in the free state, the second bore 9 has a larger diameter than that of support shoulder 7 when ring 8 is in a pre-deformed martensitic structure, the ring then having been previously deformed, which makes it possible to obtain a clamping effect upon austenitic transformation.

In a specific embodiment, in the free state, the second bore 9 of ring 8, has a larger diameter than that of support shoulder 7 when ring 8 is at an assembly temperature TM, and a smaller diameter than that of the support shoulder 7 when ring 8 is at an operating temperature TS.

According to the invention, the indenting assembly method of ring 8 includes various successive steps:

- a first initial deformation phase of the shape memory alloy ring 8 in a first martensitic state and at a lower temperature than a first transformation start temperature As, characteristic of the start of transformation of the martensitic structure into an austenitic structure upon heating;
- followed by a second phase of installing ring 8 on support shoulder 7 of cannon-pinion 1, still in the first martensitic state and at a lower temperature than the first transformation temperature As;
- a third phase, in which the clamping of ring 8 onto cannon-pinion 1 is achieved by heating to a higher temperature than a second end of transformation temperature Af, which is characteristic of the end of transformation from the martensitic structure into an austenitic structure upon heating, and which is thus higher than the first transformation temperature As. The assembly then maintains its clamping force provided it does not drop below a third transformation temperature Ms, which is characteristic of the start of transformation of the austenitic structure into a martensitic structure upon cooling (the end of this transformation corresponding to a fourth transformation temperature Mf). The use of a material with large hysteresis (difference between Ms and As), for example, allows for assembly at a temperature around ambient temperature (close to 20° C.), limited heating and the clamp-fit then maintain the properties of the material over a wide range of utilisation. The assembly temperature may therefore be within the operating temperature range (and this is even preferred to avoid the use of cryogenic cooling systems).

The object is to avoid dropping below the second transformation temperature Ms during operation, so as to avoid modifying the clamp-fit by any, even partial, phase transformation (i.e. without necessarily attaining the fourth transformation temperature Mf at which transformation from the austenitic structure into a martensitic structure is completed).

In a specific implementation, the assembly temperature TM is lower than a minimum operating temperature TSMIN, or higher than a maximum operating temperature TSMAX.

Figure 2:
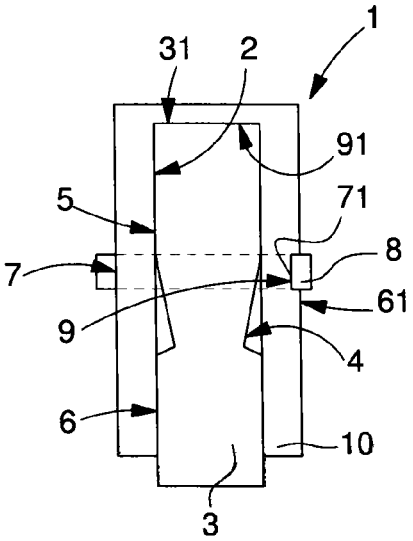
FIG. 2 shows, in a similar manner to FIG. 1, a cannon-pinion according to the invention, including a body receiving the pivot-shank, and a ring positioned with controlled clamping force onto the body to ensure controlled friction torque on the pivot-shank.
Figure 3:
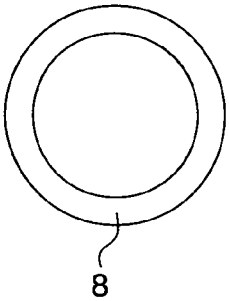
FIGS. 3 to 6 show a series of cross-sectional views in a plane passing through the ring.
Figure 4:
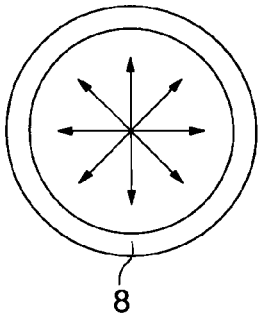
Figure 5:
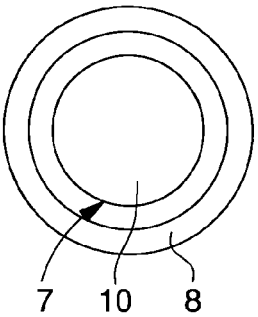
Figure 6:
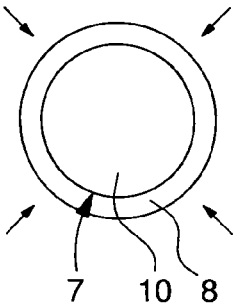
Figure 7:
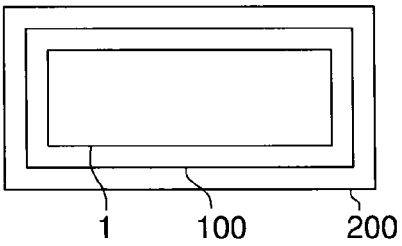
FIG. 7 shows a block diagram of a watch including a movement comprising a cannon-pinion according to the invention.

The invention is illustrated in FIG. 2, in a non-limiting manner, with a single ring 8. However, ease of implementation means that several rings 8 may be placed along pivot-shank 3.

In a specific variant, notably for particular products (with no centre-seconds), bore 2 of body 10 is a blind bore and includes an axial abutment surface 91, which is arranged to receive in abutment an end 31 of pivot-shank 3. Also, support shoulder 7 is located opposite recess 4 in pivot-shank 3 when pivot-shank 3 is abutting on said axial abutment surface 91.

More generally, the cannon-pinion is a through-hole component for a product with centre seconds. In some particular cases, the cannon-pinion may also be a through-hole component to facilitate cleaning after machining. In such case, the end can then be closed with a cap.

In a specific variant, as seen in FIG. 2, the section of recess 4 of pivot-shank 3 decreases away from end 31.

In a specific embodiment of cannon-pinion 1, support shoulder 7 is a groove 71 arranged in an outer cylindrical shoulder 61 of body 10, and, in the free state, second bore 9 has a larger diameter than that of outer cylindrical shoulder 61 when ring 8 is at assembly temperature TM.

In another specific and advantageous embodiment, shoulder 7 consists of a single variation in the outer diameter of the cannon-pinion, below shape memory ring 8, with a shoulder locking the ring downwards during assembly.

In a first embodiment, the shape memory alloy forming ring 8 is chosen so that assembly temperature TM is lower than a minimum operating temperature TSMIN of −20° C.

In a second embodiment, the shape memory alloy forming ring 8 is chosen so that the assembly temperature TM is higher than a maximum operating temperature TSMAX of +70° C.

In a variant, ring 8 is a slit ring.

In a specific embodiment, a shape memory alloy ring, whose diameter in the free state and at ambient temperature is slightly smaller than that of the cannon-pinion at the same temperature, is positioned at the place where indenting is normally performed. The ring is first deformed to enable it to pass around the cannon-pinion, then, once at the correct height, the ring is heated, returns to its austenitic shape, and clamps the cannon-pinion onto the pivot-shank. The transformation and securing temperatures must be low enough to prevent the ring from becoming loose if the watch is cold.

In another specific embodiment, the ring is made of a "Nitinol" nickel titanium alloy, in a first shape at a temperature below −40° C., and in a second shape at ambient temperature between −20° C. and +70° C., said second shape ensuring the clamping force required for proper and controlled pivot-shank friction. Medical, and particularly orthodontic tools make it possible to achieve very fast cooling to around −50° C. or −60° C., to to even lower temperatures, to make the ring take the first shape allowing it to be fitted onto the cannon-pinion body. It is sufficient simply to return the assembly to the temperature of the assembly workshop, conventionally close to +20° C., to ensure the clamp-fit of the ring in its second shape, and the friction torque measurement test can immediately be performed to validate the component for immediate use in a movement.

The invention also concerns a timepiece movement 100 comprising at least one such cannon-pinion 1.

The invention also concerns a timepiece 200 including at least one such movement 100 and/or at least one such cannon-pinion 1.

The invention also concerns an indenting method by the clamp-fit assembly of ring 8, which can easily be automated using a manipulator robot comprising means of heating or cooling in a localised and virtually instantaneous manner, via which various successive steps are performed:

- a pivot-shank 3 is inserted into a first bore 2 in a cannon-pinion body 10 in a determined position, or preferably until a stop position is reached in a particular implementation;
- a shape memory alloy ring 8 is prepared for gripping a support shoulder 7 on a tubular body comprised in said body 10 facing said pivot-shank 3, said ring 8 including a second bore 9 which, in the free state, has a larger diameter than that of the support shoulder when the ring is in a martensitic structure, and a smaller diameter than that of the support shoulder when the ring 8 is in an austenitic structure;
- a first phase is effected for the initial deformation of the shape memory alloy ring 8 in a first martensitic state and at a lower temperature than a first transformation start temperature As, characteristic of the start of transformation of the martensitic structure into an austenitic structure upon heating;
- a second phase is effected to install ring 8 on support shoulder 7 of cannon-pinion 1, still in the first martensitic state and at a lower temperature than the first transformation temperature As;
- a third phase is effected, in which ring 8 is clamped onto cannon-pinion 1 by heating to a higher temperature than a second end of transformation temperature Af.

In an advantageous variant of this method, ring 8 is preformed in its martensitic structure, to obtain a clamping effect upon transformation into an austenitic structure.

In variant of this method:

- a pivot-shank 3 is inserted into a first bore 2 in a cannon-pinion body 10 in a determined position, or preferably until a stop position is reached in a particular implementation;
- a shape memory alloy ring 8 is prepared for gripping a support shoulder 7 on a tubular body comprised in said body 10 facing said pivot-shank 3, said ring 8 including a second bore 9 which, in the free state, has a larger diameter than that of support shoulder 7 when ring 8 is at an assembly temperature TM, and a smaller diameter than that of support shoulder 7 when ring 8 is at an operating temperature, assembly temperature TM being lower than a minimum operating temperature TSMIN, or higher than a maximum operating temperature TSMAX;
- said shape memory alloy ring 8 is cooled or heated to said assembly temperature;
- said ring 8 is then fitted onto said body 10 and said ring 8 is positioned in a suitable position on said support surface 7;
- said ring 8 is held in position until the cannon-pinion assembly 1, formed of said body 10, said pivot-shank 3 and said ring 8, returns to ambient temperature.

In a variant of this method, cooling is applied to said body 10 before said ring 8 is fitted onto said body 10.

In a variant of this method, cooling or heating is applied to said assembly 1 to return it more quickly to ambient temperature.

In a variant of this method, several rings 8 are prepared and then fitted side-by-side onto said body 10 in predetermined positions.

In short, this invention consists in placing a shape memory alloy ring of slightly smaller diameter than that of the cannon-pinion at the place where indenting is usually performed. In a specific variant, the ring is first deformed to enable it to pass around the cannon-pinion, then, once at the correct height, the ring is heated, returns to its austenitic shape, and clamps the cannon-pinion onto the pivot-shank. Temperatures $M_s$ and $M_f$ must be low enough to prevent the ring from becoming loose if the watch is cold. Ideally, $A_s$ and $A_f$ are around 20° C. to 30° C., but may also have different values. FIGS. 1 and 2 illustrate the mechanism for a conventional configuration. This does not exclude the possibility of taking advantage of this mechanism to introduce other configurations which are less dependent on specific mechanical constraints. For example, the height of the indenting may be reduced; or the deformation may be induced from the interior in the opposite direction in a reverse application of the invention.

The technical terms contained in the above description (austenite, martensite $A_s$, $A_f$, $M_s$, $M_f$) are mainly relevant for heat-activated shape memory alloys. These concepts nonetheless apply to magnetically-activated shape memory alloys and to shape memory polymers.

In the case of magnetically-activated shape memory alloys, notions of transition temperatures must be replaced by notions of magnetic field thresholds. This solution is advantageous, in the case where positioning occurs under a magnetic field, to remove any possibility of loosening at a low temperature.

In the case of shape memory polymers, which are often block copolymers, the "austenitic" and "martensitic" phases do not actually exist, and the transition occurs on a molecular level at a transition temperature. This temperature may correspond to the vitreous transition temperature of one of the blocks or to its melting temperature.

In a non-limiting manner, shape memory materials that can be used for implementing the invention include:

either heat-activated shape memory alloys:

Ag—Cd
Au—Cd
Co—Ni—Al
Co—Ni—Ga
Cu—Al—Ni
Cu—Al—Be
Cu—Zn—Al
Cu—Zn—Si
Cu—Zn—Sn
Cu—Zn
Cu—Sn

In—Ti
Mn—Cu
Nb—Ru
Ni—Al
Ni—Ti
Ni—Ti—Fe
Ni—Ti—Cu
Ni—Ti—Nb
Ni—Ti—Pd
Fe—Pt
Fe—Mn—Si
Fe—Pd
Fe—Ni—Co—Ti
Ta—Ru
Ti—Ni—Hf or magnetically-activated shape memory alloys:
Ni—Mn—Ga (magnetic shape memory)

or shape memory polymers and copolymers:
PET-PEO
Polynorbornene
PE-Nylon
PE-PVA
PS-Poly(1.4-Butadiene)
Polyurethanes As a result of the invention, the clamping force of the cannon-pinion on the pivot-shank of the centre pinion is precisely controlled, in a perfectly reproducible assembly.

What is claimed is:

1. A watch cannon-pinion including a first bore for receiving a pivot-shank that includes, on either side of a recess of a given width, a first shoulder of a first length and a second shoulder of a second length, wherein said cannon-pinion is made in at least two parts and includes a body comprising internally said first bore and externally a support shoulder at least one deformable shape memory alloy ring which is arranged to take a first geometry in a first martensitic state, or a second geometry in a second austenitic state, said ring including a second bore, wherein said second bore, in a free state, has a larger diameter than the diameter of said support shoulder when said ring is in said first geometry with a structure corresponding to said first martensitic state, and a smaller diameter than the free diameter of said first support shoulder when said ring is in said second geometry with a structure corresponding to said second austenitic state.

2. The cannon-pinion according to claim 1, wherein, in the free state, said second bore has a larger diameter than that of said support shoulder when said ring is in a pre-deformed martensitic structure.

3. The cannon-pinion according to claim 1, wherein said bore of said body includes an axial abutment surface arranged to receive in abutment one end of a pivot-shank, and wherein said support shoulder is arranged to face said recess of a said pivot-shank, when said pivot-shank is abutting on said axial abutment surface.

4. The cannon-pinion according to claim 3, wherein said support shoulder is a groove arranged in an outer cylindrical shoulder of said body, and wherein, in the free state, said second bore has a larger diameter than that of said outer cylindrical shoulder when said ring is at an assembly temperature.

5. The cannon-pinion according to claim 1, wherein said shape memory alloy is chosen so that an assembly temperature is lower than a minimum operating temperature of −20° C.

6. The cannon-pinion according to claim 1, wherein said shape memory alloy is chosen so that an assembly temperature is higher than a maximum operating temperature of +70° C.

7. The cannon-pinion according to claim 1, wherein said ring is a slit ring.

8. A timepiece assembly including a pivot-shank which includes, on either side of a recess of a given width, a first shoulder of a first length and a second shoulder of a second length, and the cannon-pinion according to claim 1, wherein, in an assembled and clamped position of said assembly, said pivot-shank is held confined in said bore of said cannon-pinion, and wherein, in said assembled and clamped position of said assembly, said ring of said cannon-pinion is clamped in abutment on said support shoulder opposite to said recess in said pivot-shank.

9. The timepiece assembly according to claim 8, wherein, in said assembled and clamped position of said assembly, said ring of said cannon-pinion is clamped in abutment on an outer cylindrical shoulder of said body forming said support shoulder, or on a groove arranged in an outer cylindrical shoulder of said body.

10. The timepiece assembly according to claim 9, wherein a section of said recess of said pivot-shank decreases away from said end.

11. A timepiece movement including at least one assembly according to claim 8.

12. A timepiece including at least one movement according to claim 11.

13. A method of indenting by assembling a ring on a cannon-pinion body confining a pivot-shank, including various successive steps:

a pivot-shank is inserted into a first bore of a cannon-pinion body;

a shape memory alloy ring is prepared which is arranged to take a first geometry in a first martensitic state, or a second geometry in a second austenitic state, said ring being prepared to grip a support shoulder on a tubular body comprised in said body facing said pivot-shank, said ring including a second bore which, in a free state, has a larger diameter than that of the support shoulder when said ring is in said first geometry with a structure corresponding to said first martensitic state, and a smaller diameter than that of said first support shoulder when said ring is in said second geometry with a structure corresponding to said second austenitic state;

a first phase is effected for the initial deformation of said shape memory alloy ring in said first martensitic state and at a lower temperature than a first transformation start temperature As, characteristic of the start of transformation of the martensitic structure into an austenitic structure upon heating;

a second phase is effected to install said ring on said support shoulder, still in said first martensitic state and at a lower temperature than the first transformation temperature As;

a third phase is effected, in which said ring is clamped onto said body by heating to a higher temperature than a second end of transformation temperature Af.

14. The method according to claim 13, wherein said ring is pre-formed in the martensitic structure thereof.

15. The method of indenting, wherein:

a pivot-shank is inserted into a first bore in a cannon-pinion body in a determined position or until a stop position is reached;

a shape memory alloy ring is prepared for gripping a support shoulder on a tubular body comprised in said body facing said pivot-shank, said ring including a second bore which, in a free state, has a larger diameter than that of said support shoulder when said ring is at an assembly temperature, and a smaller diameter than that of said support shoulder when said ring is at an operating temperature, said assembly temperature being lower than a minimum operating temperature, or higher than a maximum operating temperature;

said shape memory alloy ring is cooled or heated to said assembly temperature;

said ring is then fitted onto said body and said ring is positioned in a suitable position on a support surface;

said ring is held in position until a cannon-pinion assembly, formed of said body, said pivot-shank and said ring, returns to ambient temperature.

16. The method according to claim 15, wherein said ring is pre-formed in a martensitic structure thereof.

* * * * *